US007182213B2

(12) United States Patent
King

(10) Patent No.: US 7,182,213 B2
(45) Date of Patent: Feb. 27, 2007

(54) CLOSURE ASSEMBLY FOR A WIDE MOUTH VESSEL

(75) Inventor: Roger Milner King, Buckinghamshire (GB)

(73) Assignee: Beeson and Sons Limited, Rickmansworth (GB)

( * ) Notice: Subject to any disclaimer, the term of this patent is extended or adjusted under 35 U.S.C. 154(b) by 0 days.

(21) Appl. No.: 10/496,050

(22) PCT Filed: Nov. 19, 2002

(86) PCT No.: PCT/GB02/05183

§ 371 (c)(1),
(2), (4) Date: Jun. 30, 2004

(87) PCT Pub. No.: WO03/045805

PCT Pub. Date: Jun. 5, 2003

(65) Prior Publication Data

US 2005/0082249 A1 Apr. 21, 2005

(30) Foreign Application Priority Data

Nov. 20, 2001 (GB) ..... 0127836.5

(51) Int. Cl.
*B65D 41/04* (2006.01)

(52) U.S. Cl. ..... 215/330; 220/296

(58) Field of Classification Search ..... 215/330, 215/329, 307, 222, 331, 332, 208; 220/293, 220/296, 297, 300, 301, 298
See application file for complete search history.

(56) References Cited

U.S. PATENT DOCUMENTS 1,158,073 A * 10/1915 Payne ..... 220/258.3
1,612,449 A * 12/1926 Lee ..... 215/331
3,612,324 A * 10/1971 Malick ..... 215/222
3,880,314 A * 4/1975 Akers ..... 215/214
4,032,028 A * 6/1977 Reiss et al. ..... 215/217
4,739,890 A * 4/1988 Cooke ..... 215/222
4,953,728 A * 9/1990 Meek ..... 215/250
5,967,352 A 10/1999 Repp et al.

(Continued)

FOREIGN PATENT DOCUMENTS

GB 1 343 572 1/1974

(Continued)

*Primary Examiner*—Lien M. Ngo
(74) *Attorney, Agent, or Firm*—Stephen B. Salai, Esq.; Brian B. Shaw, Esq.; Harter Secrest & Emery LLP

(57) ABSTRACT

A closure assembly includes: a vessel opening; a closure for said opening, the closure having a base portion and a skirt portion; a first screw thread on the opening, said first screw thread having one or more first thread segments; a second screw thread on an inner surface of the skirt of the closure, said second screw thread having one or more second thread segments; said first and second screw threads being configured to enable a user to secure, remove and resecure the closure into a sealing position on the opening by rotation of the closure on the opening; wherein the first thread segments are shorter than said second thread segments; and wherein the second thread segments are each made up of one or more radially spaced projecting portions, each said portion extending radially no more than about 60° around the closure skirt.

26 Claims, 2 Drawing Sheets

U.S. PATENT DOCUMENTS 6,006,930 A * 12/1999 Dreyer et al. ..... 215/44
6,015,054 A 1/2000 King
6,227,391 B1 5/2001 King

FOREIGN PATENT DOCUMENTS

GB 2 138 574 A 10/1984
GB 2 311 285 A 9/1997
GB 2 319 513 A 5/1998
GB 2 330 133 A 4/1999

* cited by examiner

CLOSURE ASSEMBLY FOR A WIDE MOUTH VESSEL

TITLE OF THE INVENTION

BACKGROUND OF THE INVENTION

1. Field of the Invention

The present invention relates to improved threaded closure assemblies for wide mouth vessels, in particular for drinking vessels. The invention also provides improved threaded closure caps for use in such assemblies.

2. Description of Related Art

The term "drinking vessel" refers to a container having an opening at the top sufficiently large to allow a liquid to be sipped from the opening. For example it may be a drinking glass or cup. The present invention allows a range of everyday drinking glass and cup configurations to be fitted with secure, leak-tight and optionally also pressure tight closures. It will be appreciated that the closure assemblies of the present invention are also suitable for a range of other wide-mouth containers, especially those for the storage of materials under pressure.

Current commercially mass-produced beverage containers use threads on the container neck and closure of the continuous, helical type. The threads comprise a single, substantially continuous thread portion on the container neck with a low thread pitch angle, typically less than 5°. The low pitch angle is needed in order to ensure that the closure does not unscrew spontaneously. The low pitch angle also provides the necessary leverage to achieve an air tight compressive seal between the closure and the container neck when the closure is tightened onto the container neck. The low pitch of the helical threads also means that the closure typically needs to be rotated through more than 360° to disengage it completely from the container neck.

Drawbacks of these low pitch helical threads include the laborious rotation required to remove and resecure the closure on the neck, excessive use of molding material to form the long helical threads, and unreliable separation of tamper-evident rings from the closure skirt due to the low pitch angle of the threads. The difficulty of securing the closure on the neck is especially severe for drinking vessels, since the very low-angle threads needed for large openings are easily crossed. Furthermore, the problem of excessive use of molding material is especially severe for the larger opening of a drinking vessel.

The present applicant has described an improved pressure safety closure for carbonated beverage containers in International Patent application WO95/05322. This application describes container closure assemblies having substantially continuous threads defining a substantially continuous helical thread path, although the pitch of the helix can vary. The closure can be moved from a fully disengaged to a fully secured position on the container neck by rotation through 360° or less. The threads on the neck or the closure are provided with mutually engageable elements to block or restrict rotation of the closure in an unscrewing direction beyond an intermediate position when the closure is under an axial pressure in a direction emerging from the container neck, the neck and closure being constructed and arranged to provide a vent for venting gas from the container neck at least when the closure is in the intermediate position. This pressure safety feature prevents the closure from blowing off uncontrollably once unscrewing of the closure from the container neck has started. It thus allows the use of shorter, more steeply pitched or multiple-start threads in the container and closure assembly, thereby rendering the assembly much more elderly- and child-friendly without sacrificing pressure safety. WO97/21602 and WO99/19228 describe improved versions of the assemblies of WO95/05322.

The beverage container closure assemblies exemplified in WO95/05322 have short projecting thread segments on the cap and longer (but still short relative to conventional low-pitch closure assemblies) projecting thread segments on the container neck. This arrangement is conventional, in part because of the requirements of high-speed injection molding of the caps, according to which the caps must be "bumped" off a (preferably) one-piece mold mandrel with minimum distortion.

Interestingly, the various screw-top formats for beverage containers have not yet completely replaced glass bottles with crown closures. This is despite the fact that crown closures require a bottle opener to open, and cannot be resecured on the bottle neck in airtight fashion, thereby making it necessary to consume the whole contents of such a bottle immediately after opening.

The present applicant considers that one of the reasons for the continued use of crown closures is that they are better suited for consumption directly from the bottle because the relatively smooth surfaces of the bottle neck are more comfortable between the consumer's lips. This characteristic will be referred to as the "user-friendliness" of the bottle neck. In contrast, screw top container necks have neck threads that present a relatively rough or abrasive surface to the lips.

It is an object of the present invention to provide improved screw top closure assemblies for drinking vessels. The present invention is especially applicable to drinking vessels containing beverages, including carbonated beverages.

BRIEF SUMMARY OF THE INVENTION

The present invention provides a threaded closure assembly for a drinking vessel comprising: a threaded opening (neck) at the top of the drinking vessel; a closure for said opening, the closure having a base portion and a skirt portion; a first screw thread on the opening, said first screw thread comprising one or more first thread segments; a second screw thread on an inner surface of the skirt of the closure, said second screw thread comprising one or more second screw thread segments; said first and second screw threads being configured to enable a user to secure, remove and resecure the closure onto a sealing position on the opening by simple rotation of the closure on the opening; wherein said first thread segments are shorter than the second thread segments, and wherein the second thread segments are each made up of a plurality of radially spaced projecting portions, each said portion extending radially no more than about 60° around the closure skirt.

The term "drinking vessel" refers to a container having an opening (neck) at the top sufficiently large to allow a liquid to be sipped from the opening. Normally the opening of a drinking vessel has an inside diameter of at least about 3 cm, preferably from about 4 cm to about 10 cm, and more preferably from about 5 cm to about 8 cm. The opening is normally substantially cylindrical. The present invention is also applicable to other wide-mouth containers having openings with these preferred diameters.

In certain embodiments the drinking vessel has a substantially tubular shape, for example it may in the shape of a drinking glass. In certain embodiments, the opening at the top has an area of at least about 50% of the area of the base of the vessel, preferably at least about 80% of the area of the base of the vessel, and in certain embodiments the area of the opening at the top of the vessel is greater than the area of the base of the vessel.

The drinking vessel, is preferably formed from thermoplastic material, that is to say from a molded polymer, but it may be formed from glass. The threaded opening is preferably formed in one piece with the drinking vessel.

The closure is preferably made from injection-molded thermoplastic, and it is a particular advantage of the present invention that the closures can easily be manufactured by high-speed injection molding, as will be described further below.

Preferably, there are at least four of said first thread segments. In the larger opening formats especially there may be eight, twelve, sixteen or more of the first thread segments. The number of second thread segments is typically the same as the number of first thread segments. Preferably, this results in a number of thread starts equal to the number of first thread segments, or preferably at least two thread starts, more preferably at least four, most preferably eight, twelve, sixteen or more thread starts.

The first thread segments on the opening are shorter than the second thread segments. That is to say, they extend radially around the opening by a lesser angle than the angle through which the second thread segments extend around the closure skirt. The first thread segments do not extend all the way around the opening, and normally they do not overlap around the opening. Preferably, at least one of the first thread segments extends circumferentially from about 1 to about 30 degrees around the opening, more preferably from about 2 to about 15 degrees, more preferably from about 3 to about 10 degrees, and more preferably all of the first thread segments so extend. Preferably, the maximum length of each first thread segment is from about 2 to about 20 mm, more preferably from about 4 to about 15 mm, more preferably from about 6 to about 12 mm. Preferably, at least about 40% of the circumference of the opening is free of the first thread segments, more preferably from about 50% to about 95% of the circumference of the opening is free of the thread segments. The absence of the thread segments from the major part of the circumference of the opening increases the user-friendliness of the opening.

Preferably, all of the first thread segments have substantially the same shape and configuration, whereby the number of thread starts may be equal to the number of first thread segments.

The term "first thread segment" typically refers to an elongate, pitched projection on the outside of the opening. It preferably does not refer to a simple projecting boss or peg. The mean pitch of the first thread segment surfaces is preferably from about 5° to about 25°, more preferably from about 10° to about 20°. The upper and lower surfaces of the first thread segments may have different pitches, and the pitch along one or other of said surfaces may also vary. Preferably, at least one of said surfaces has at least one constant pitch region extending for at least about 2 mm, preferably about 5 mm to about 20 mm around the opening. For example, the first thread segment may be a short helical thread segment having rounded ends, similar to the thread segments on the closure caps described in detail in WO95/05322 or WO97/21602.

The first thread segments may be substantially triangular, rectangular, rounded or chamfered rectangular, or trapezoidal in cross-section along the longitudinal axis of the vessel. Preferably, the first thread segments are smoothed. That is to say, at least one edge of the segments is shaped to present a rounded or chamfered cross-section along the longitudinal axis of the vessel instead of a triangular, rectangular or trapezoidal cross-section between the side of the segment and the top of the segment. Preferably, substantially all of the edges of the segment are smoothed in this way. Preferably, this results in an increased radius of curvature between the top of the segment and the side of the segment relative to the prior art. For example the radius of curvature may be at least 0.5 mm, more preferably at least 1 mm or 2 mm. Preferably, the cross-section of the segments taken along the longitudinal axis of the vessel is a substantially continuous curve such as a semicircle or sinusoidal curve. This smoothed profile improves the user-friendliness of the opening thread finish.

Preferably, the maximum radial height of the first thread segments above the cylindrical base of the thread finish on the opening is greater than 0.1 mm, more preferably greater than 0.2 mm and still more preferably from 0.5 to 3 mm, most preferably from 1 to 2 mm. Preferably, the width of the first thread segments (measured along the longitudinal axis of the vessel) is from 1 mm to 6 mm, more preferably from 2 mm to 4 mm. The use of such relatively large and high thread segments helps make it possible to produce a user-friendly neck finish onto which a suitable screw top can be secured and resecured in pressure-secure fashion. Nevertheless, the shortness of the first thread segments and the usual rounded or smoothed cross-section of the first thread segments enables the relatively high thread finish on the opening to be made user-friendly, in particular to be made comfortable to the lips of a user drinking directly from the opening.

Preferably, the second thread segments on the inside of the closure skirt define a substantially continuous helical thread path along which the first thread segments travel from a substantially fully disengaged to a substantially fully secured position of the closure on the threaded opening. That is to say, the first and second threads do not engage in a stepped fashion like a bayonet closure (which is normal for short thread segments), but rather in a conventional continuous helical screw fashion. In other words, the pitch of the thread path is normally less than 90 degrees throughout its length. It will be appreciated that the pitch of the helix may not be constant. Preferably, the mean pitch of the helical thread path is from 5 to 20 degrees.

The continuous thread path renders the assembly especially easy to close by the elderly and infirm, or by children. In contrast, bayonet-type threads of the kind described in U.S. Pat. No. 5,135,124 require a relatively complex, stepped manipulation to secure the closure onto the opening, with the result that the closure is often inadequately secured. Furthermore, it is extremely difficult to devise a tamper-evident ring for the closure that separates reliably and easily upon opening of a bayonet-type closure assembly. Finally, a continuous thread is easier for physically weak people to screw down against pressure from inside the vessel than a bayonet thread.

The second thread segments are not bayonet-type thread segments. The second thread segments extend around the closure skirt a sufficient distance so that a top portion of one thread segment is proximate to a bottom portion of another thread segment, that is to say sufficiently close to the adjacent thread segment that the gap between them is too narrow to allow one of the first thread segments to pass through vertically. In certain embodiments, respective top and bottom portions of adjacent second thread segments are circumferentially overlapping.

Preferably, at least one of the second thread segments extends for at least about 30°, preferably at least 45° around the closure skirt, more preferably at least 60° around the closure skirt. A thread gap is defined between the said top and bottom portions of the thread segments. One of the first thread segments travels through this thread gap as the closure is screwed onto or off the vessel opening.

Preferably, there are eight, twelve or sixteen of the second thread segments. Preferably the first and second thread segments define a four-start, eight-start or twelve-start substantially continuous and fast-pitched thread path.

Preferably, the closure can be moved from a fully released to a fully engaged position on the opening (or vice-versa) by a single smooth rotation through about 180 degrees or less, more preferably about 90 degrees or less, and most preferably about 45 degrees or less.

Preferably, the maximum radial height of the second thread segments above the cylindrical surface of the closure skirt is greater than about 0.1 mm, more preferably greater than about 0.2 mm and still more preferably from about 0.5 to about 3 mm, most preferably from about 1 to about 2 mm. Preferably, the width of the second thread segments (measured along the longitudinal axis of the closure skirt) is from about 1 mm to about 6 mm, more preferably from about 2 mm to about 4 mm.

The second thread segments are each made up of one or more radially spaced projecting portions, each said portion extending radially no more than about 60° around the closure skirt, preferably no more than about 45° around the closure skirt, more preferably from about 2° to about 35° around the closure skirt. The radially spaced projecting portions are preferably radially spaced apart by gaps extending radially from 0 to about 10°, preferably from about 0.5° to about 2°. Preferably, the width of gaps is from about 0.1 mm to about 5 mm, more preferably from about 0.5 mm to about 2 mm. In other words, the second thread is preferably a broken or interrupted thread having a plurality of gaps in each thread segment, but the gaps being sufficiently radially narrow not to interfere with the operation of the second thread segments. That is to say, the second thread segments still define a substantially continuous helical thread path therebetween. This requires the gaps in the second thread segments (as well as the gaps between the second thread segments) to be radially narrower than the first thread segments.

Preferably, each second thread segment is made up of at least two portions, preferably at least three or four portions, and this implies preferably at least one or preferably at least two or three gaps in the thread segment. The presence of the gaps in the second thread segments may improve gas venting through the second thread when opening pressurised containers. More importantly, the closure caps are easier to bump off a one-piece mold mandrel during high speed manufacturing, because the broken threads offer less resistance to radial expansion of the closure skirt.

Preferably, at least one of the second thread segments also has a smoothed cross section. The second thread cross section is preferably complementary to the cross section described above for the first thread segments. It will be appreciated that this can result in a better fit between the first and second thread segments, for example if they have matching cross-sectional shapes parallel to the axis of rotation. Moreover, tapered or smoothed threads on the closure make it easier to bump the closure off a mold mandrel, thereby assisting high-speed manufacture of the closures by injection molding without the need for multi-part mold pieces.

The present invention is applicable to a wide variety of drinking vessels of any shape in which user friendliness is desirable, including drinking vessels for both carbonated and non-carbonated beverages. The present invention is applicable to molded thermoplastics container closure assemblies, and also to glass or metal container closure assemblies, and to combinations thereof (e.g. a glass vessel with a metal or thermoplastic closure).

Preferably, the container closure assembly according to the present invention further comprises complementary locking means on the vessel opening and the closure that resist unscrewing of the closure from the fully engaged position on the opening after the closure has been secured or resecured on the opening until a predetermined minimum opening torque is applied. These elements enable more steeply pitched threads and free running (parallel) threads to be used without risk of the closure unscrewing spontaneously. The use of more steeply pitched threads in turn makes it possible to use wider and higher thread segments within the size and height constraints of a normal neck finish.

Preferably, the locking means on the opening comprises a projection or recess for engagement with a complementary projection or recess on the closure skirt. More preferably, the projection or recess on the opening is smoothed as hereinbefore defined.

More preferably, the locking means comprise a longitudinal locking rib on the vessel opening, and a complementary locking ramp on the skirt portion of the closure, wherein the locking rib abuts against a retaining edge of the locking ramp when the closure is fully engaged on the opening. In alternative preferred embodiments, a locking recess such as a longitudinal groove may be provided in one or more of the first or second thread segments, and a longitudinal locking rib is provided on the other of the opening or on the skirt portion of the closure, whereby the locking rib is received in the recess in the thread segments at the fully engaged and sealing position of the closure on the opening. Locking means of this kind are described in detail in WO91/18799 and WO95/05322, the entire disclosures of which are expressly incorporated herein by reference.

The complementary locking means provide a number of important advantages. Firstly, they prevent accidental backing off of the closure from the fully engaged and sealing position on the vessel due to pressure from inside the container. This also permits the use of more steeply pitched threads. Furthermore, the locking means provide a positive "click" when the fully engaged and sealing position of the closure is reached, thereby giving the user a positive indication of that position. This helps to ensure that exactly the right degree of compression is applied between the container and closure to achieve an effective airtight seal.

Preferably, the container closure assembly according to the invention is an assembly for a carbonated beverage, wherein the container further comprises mutually engageable elements on the vessel opening and the closure to block or restrict rotation of the closure in an unscrewing direction beyond an intermediate position when the closure is under axial pressure in a direction emerging from the vessel. This is the so-called pressure safety feature that is intended to prevent the closure unscrewing uncontrollably or missiling as it is removed from a vessel under pressure. Preferably, the preferred embodiments of this pressure safety feature are as described in WO95/05322, WO97/21602 and WO99/19228, the entire contents of which are expressly incorporated herein by reference.

Preferably, the first and second screw threads are constructed and arranged to permit axial displacement of the closure relative to the vessel opening at least when the closure is at the said intermediate position, and preferably the engageable elements are adapted to engage each other when the closure is axially displaced in a direction emerging from the opening, for example by axial pressure from inside the pressurized vessel. More preferably, the mutually engageable elements are constructed and arranged not to mutually engage each other when the closure is axially displaced in a direction inwardly towards the vessel at the intermediate position, for example when the closure is being screwed down onto the vessel opening.

Preferably, the mutually engageable elements comprise a step or recess formed in the upper surface of one of the second screw thread segments to provide a first abutment surface against which a second abutment surface on one of the first screw thread segments abuts to block or restrict rotation of the closure in an unscrewing direction at the said intermediate position when the closure is under axial pressure in a direction emerging from the vessel. (The term "upper" in this context means closer to the base of the closure, i.e. further from the open end of the closure).

More preferably, the second thread segment comprises a first thread portion having a first longitudinal cross section and a second thread portion having a second longitudinal cross section narrower than the first cross section, whereby the first thread segment abuts against the second thread portion. The relatively broad first cross section is preferably adjacent to the circumferentially overlapping region of the second thread segments, resulting in a relatively narrow thread gap in that region.

The assemblies according to the present invention preferably further comprise additional means for forming a pressure-tight seal between the vessel and the closure. In certain embodiments the sealing means comprise a compressible liner inside the base portion of the closure for abutting against a lip of the vessel opening. Preferably, the sealing liner is formed from a compressible elastomer. A circumferential sealing rib may be provided on the lip of the opening, or inside the base of the closure underneath the sealing liner, in order to optimise compression of the elastomer to achieve a pressure-tight seal. However, preferably, the lip of the vessel is smooth and rounded in order to optimise its user-friendliness.

In other embodiments, the sealing means may comprise a cylindrical sealing plug that projects concentrically and inside the closure skirt and that forms a pressure-tight seal with the inside of the vessel proximate to the opening.

Preferably, the first and second threads on the vessel opening and closure are variable pitch threads, preferably as described in WO97/21602, the entire contents of which are incorporated herein by reference. Preferably, the pitch of an unscrewing thread path defined by the first and the second thread segments is relatively lower in a first region and relatively higher in a second region displaced from the first region in an unscrewing direction. The pitch of the thread path in the first region is preferably substantially constant. The first region normally includes the position at which the closure is sealed on the vessel. Preferably, the first region extends for about 2° to 40°, preferably 5° to 20° about the circumference of the vessel opening or the closure skirt. Preferably, the pitch of the lower thread surface in the first region is in the range of 1° to 12°, more preferably 2° to 8°.

Preferably, the second region is adjacent to the first region of the thread path. Preferably, the pitch of the helical thread path in the second region is substantially constant, and the second region preferably extends for about 2° to about 35°, preferably for about 5 to 15° about the circumference of the container neck or the closure skirt. Preferably, the pitch of the thread path in the second region is in the range of 15° to 35°.

The use of a variable pitch thread renders it easier to combine fast-turn threads having a steep average pitch that are elderly-and child-friendly with pressure safety. A problem that could arise with fast-turn threads is that they are steeply pitched, which results in a tendency to back off from the fully secured position on the vessel when the container is pressurized. This problem can be overcome by using bayonet-type threads, but the use of bayonet-type threads results in a number of different problems, as described above. In contrast, the variable pitch threads solve the problem of backing off of the closure under pressure, whilst retaining all of the advantages of continuous, fast-turn threads.

Preferably, the helical unscrewing thread path further comprises a third region adjacent to the second region, wherein the third region has a relatively low pitch. Preferably, the third region has a relatively constant pitch, preferably in the range 1 to 12°, more preferably 2 to 8°. The third region preferably includes the position of the closure on the opening when the closure is blocked at the intermediate gas venting position. The relatively low pitch of the third region reduces the tendency of the closure to override the blocking means at high gas venting pressures.

In certain embodiments, the closure assembly includes a recess in the inner surface of the closure skirt, the recess being located between and circumferentially overlapping two of the plurality of second thread segments to increase the cross-sectional area provided for gas venting between the second thread segments.

It has been found that the thread gap between overlapping portions of adjacent second thread segments may have a cross-section that is too small for optimal gas venting in all circumstances. The recess overcomes this difficulty by increasing the cross-section of the thread gap to increase the rate of gas venting through the thread gap.

The increased cross-sectional area of the venting pathway in the circumferentially overlapping regions of the second thread permits faster venting of pressure from inside the vessel, and thereby reduces the length of time that the closure is blocked at the intermediate position while venting takes place, without any loss of pressure safety.

In these embodiments, the recess may comprise an elongate groove extending around the the closure skirt between the second thread segments in the said overlapping regions. Preferably, the elongate groove extends substantially parallel to the helical thread path. Preferably, the recess comprises an elongate groove in the inside of the closure skirt. Preferably, the longitudinal cross-sectional area of the recess is from 5% to 50% of the mean longitudinal cross-sectional area of the second thread segment portions adjacent to the recess.

Specific embodiments of the drinking vessel closure assemblies according to the present invention will now be described further, by way of example, with reference to the accompanying drawings, in which:—

BRIEF DESCRIPTION OF THE SEVERAL VIEWS OF THE DRAWINGS(S)

DETAILED DESCRIPTION OF THE INVENTION

Figure 2:
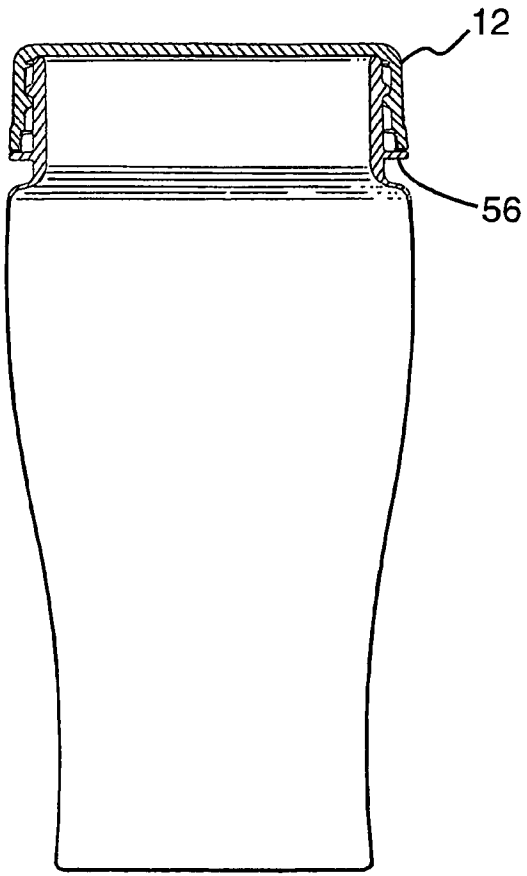
FIG. 2 shows a longitudinal cross sectional view of the drinking vessel of FIG. 1 with the closure resecured on the vessel opening, and with a tamper evident ring removed.
Figure 1:
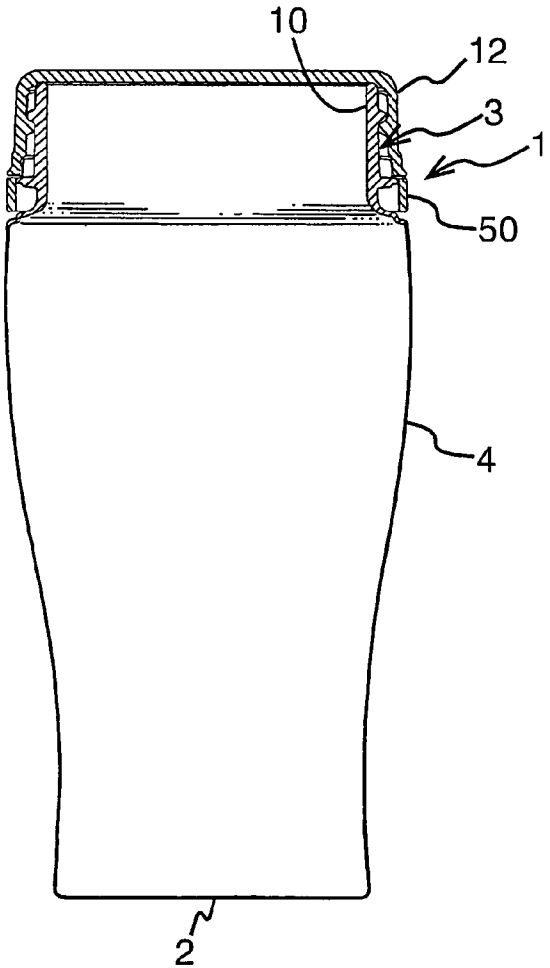
FIG. 1 shows a longitudinal cross sectional view of a drinking vessel incorporating a closure assembly according to the present invention with the closure in the fully engaged position on the vessel opening, and with a tamper evident ring attached to the closure.

Referring to FIGS. 1 and 2, this embodiment is a drinking vessel 1 in the shape of a drinking glass having a base 2 of diameter about 5 cm and a top 3 of internal diameter about 7 cm and a tubular body 4 of circular cross-section. The aesthetic and practical appeal of such a liquid packaging format is clear, but it has not hitherto been possible to make a reliable closure assembly for such wide-mouth containers.

The main features of this assembly resemble those of the assembly described and claimed in our International Patent Applications WO95/05322 and WO97/21602 and WO99/19228, the entire contents of which are expressly incorporated herein by reference. However, it is important to note that the threads on the closure and the vessel opening are reversed in the present invention relative to the closure assemblies described in those applications. That is to say, the earlier patent specifications describe in detail assemblies having short thread segments in the closure skirt and longer thread segments on the neck, whereas the present invention provides only short thread segments on the vessel opening and longer thread segments on the closure skirt.

The assembly is especially suitable for the storage of carbonated beverages, such as beer. It includes an opening 10 at the top of the vessel and a closure 12. Both the vessel and the closure are formed from plastics material. The vessel is preferably formed by injection molding, blow molding and/or thermoforming of polyethylene terephthalate or polystyrene in the manner conventionally known for such containers. The closure is preferably formed by injection molding of polypropylene.

Figure 3:
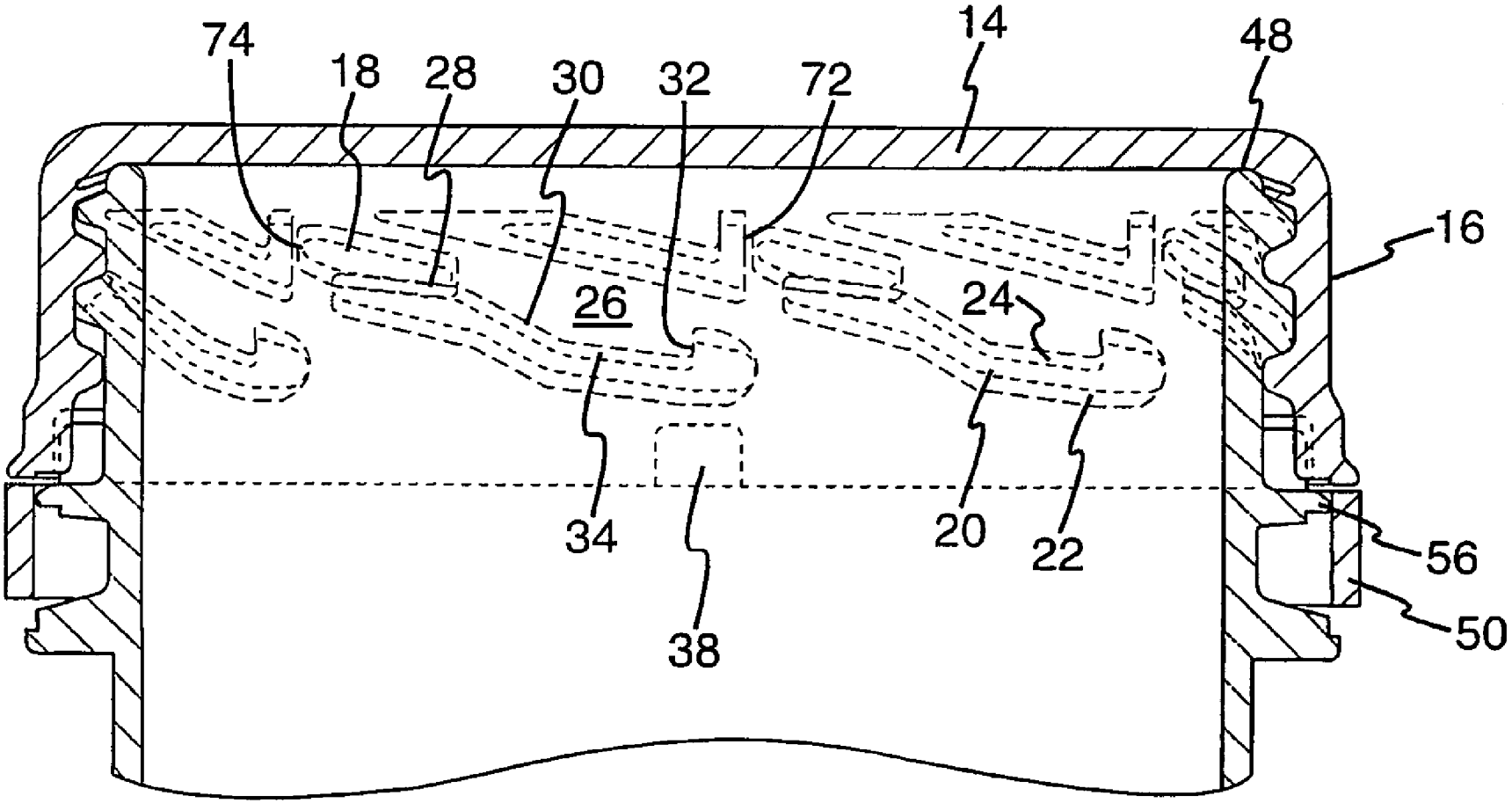
FIG. 3 shows a detail of the closure region of the cross-section of FIG. 1 with the first and second thread segments on the back of the assembly shown in phantom.

Referring to FIG. 3, the vessel opening 10 is provided with an eight-start first screw thread made up of eight first thread segments 18, as shown in FIG. 3. The first thread segments 18 are short thread segments extending about 10–15 mm around the opening and having a lower surface with relatively low pitch of about 6° and an upper surface with intermediate pitch of about 13.5°. (The term "upper" in this context means closer to the open end of the vessel). The first thread segments 18 present a substantially trapezoidal cross-section along the axis of the vessel. The vessel has a rounded lip to enhance the user-friendliness of the opening.

Referring to FIGS. 1 and 3, the closure 12 comprises a base portion 14 and a skirt portion 16. The closure skirt 16 is provided with a second screw thread formed from eight second thread segments 20, each having a lower thread surface 22 and an upper thread surface 24. (The term "upper" in this context means closer to the base of the closure, i.e. further from the open end of the closure). The upper and lower second thread surfaces 22, 24 give the thread segments substantially trapezoidal side edges that are complementary to the shape of the first thread segments. A substantially continuous, approximately helical thread gap 26 is defined between overlapping regions of the said upper and lower surfaces 22, 24 on adjacent second thread segments 20.

An important feature of this assembly is the profiling of the upper surfaces 24 of the second thread segments 20, which is described in more detail in our International patent application WO97/21602. The upper thread surfaces 24 in a first, upper region 28 have a substantially constant pitch of only about 6°. The upper region 28 adjoins an intermediate region 30 having a substantially constant, much higher pitch of about 25°. The average pitch of the helical thread path defined by the second thread segments 20 is 13.5°.

The second thread segments 20 also include a pressure safety feature similar to that described and claimed in our International Patent Application WO95/05322. Briefly, the lowermost portion of the second thread segment 20 defines a step to abut against an end of the first thread segments 18 and block unscrewing of the closure 12 from the opening 10 when the said first thread segments 18 are in abutment with the upper surface 24, i.e. when there is a net force on the closure in an axial direction out of the vessel. A third region 34 of the upper surfaces 24 of the second thread segments situated adjacent to the step 32 also has a low pitch of about 6°.

The closure assembly is also provided with complementary locking elements 38 on the vessel opening and the closure to block unscrewing of the closure from the fully engaged position on the vessel unless a minimum unscrewing torque is applied. These locking elements comprise four equally radially spaced locking ribs on the opening, and four equally radially spaced retaining ramps on the inside of the closure skirt 16. The ramps comprise a radially sloped outer face and a radially projecting retaining edge against which the rib on the closure abuts when the closure is fully engaged on the opening. The complementary locking means may be as described in our International Patent Application WO91/18799, the entire content of which is hereby expressly incorporated by reference. However, the locking rib is on the vessel and not on the closure in this embodiment, which also helps to improve the user-friendliness of the container neck finish, especially with a suitably smoothed rib.

The closure assembly also comprises means for forming a gas-tight seal between the closure and the vessel. This means may comprise a gas-tight elastomeric sealing liner that is compressed against the lip of the vessel. Optimum sealing is preferably achieved when the elastomeric sealing liner is compressed to between 30% and 70% of its original thickness. In other embodiments, sealing may be achieved without the need for a liner, for example by compression of suitably configured circumferential sealing plug, ribs and/or fins on the closure cap against the opening. Suitable sealing arrangements are described in our copending application WO02/42171, the entire content of which is incorporated herein by reference.

The second thread segments 20 terminate at their lower end in a projecting portion that defines a longitudinal shoulder 72 forming a first stop against which a second end 74 of the first thread segments 18 may abut thereby to block overtightening of the closure.

The closure assembly optionally also comprises a tamper-evident safety feature. This comprises a tamper-evident ring 50 that is initially formed integrally with the skirt 16 of the container closure 12 and joined thereto by frangible bridges. The tamper-evident ring 50 comprises a plurality of integrally formed, flexible, radially inwardly pointing retaining tabs. A circumferential retaining lip 56 is provided on the vessel opening 10. Ratchet projections (not shown) may also be provided on the vessel below the circumferential retaining lip 56 and radially spaced around the opening to block rotation of the tamper-evident ring 50 on the opening 10 in an unscrewing direction. However, it may be preferred to smooth or omit the ratchet projections in order to improve user-friendliness of the vessel opening finish. The structure and operation of the tamper-evident ring feature are as described and claimed in our International Patent Application WO94/11267, the entire contents of which are expressly incorporated herein by reference.

In use, the closure 12 is secured onto the vessel opening 10 by screwing down in conventional fashion. The closure 12 can be moved from a fully disengaged position to a fully engaged position on the vessel by rotation through about 45°. When the closure is being screwed down, there is normally a net axial force applied by the user on the closure into the vessel, and accordingly the first thread segments 18 abut against and ride along the upper surfaces 22 of the projecting portions of the second thread segments 20 on the closure skirt. It can thus be seen that the first thread segments follow a substantially continuous path along a variable pitch helix. The first and second threads are free-running, which is to say that there is substantially no frictional torque between the thread segments until the fully engaged position is neared. These features of a 45° closure rotation, substantially continuous thread path and free-running threads all make the closure extremely easy to secure and resecure, especially for elderly or arthritic persons, or children.

As the closure nears the fully engaged position on the vessel opening 10, several things happen. Firstly, the tamper-evident ring 50 starts to ride over the retaining lip 56 on the vessel opening. The retaining tabs on the tamper-evident ring 50 flex radially outwardly to enable the tamper-evident ring to pass over the retaining lip 56 without excessive radial stress on the frangible bridge.

Secondly, the locking ribs on the vessel opening ride up the outer ramped surface of the retaining ramps on the closure skirt 16. The gentle slope of the ramped surfaces, together with the resilience of the closure skirt 16, mean that relatively little additional torque is required to cause the locking ribs to ride up the ramped surfaces.

Thirdly, the initial abutment between the sealing liner or other sealing means in the container closure base and the sealing lip 48 on the vessel results in a net axial force on the closure in a direction out of the vessel. This pushes the thread segments 18 out of abutment with the lower surfaces 22 of the projecting portions of the second thread segments 20 and into abutment with the upper surfaces 24 of the projecting portions of the second thread segments 20. More specifically, it brings the first thread segments 18 into abutment with the upper regions 28 of the projecting portions of the upper thread surfaces 24. Continued rotation of the closure in a screwing-down direction causes the first thread segments 18 to travel along the upper regions 28 until the final, fully engaged position shown in FIG. 3 is reached. The low pitch of the upper surfaces 28 means that this further rotation applies powerful leverage (camming) to compress the sealing liner against the sealing rib 48 in order to achieve an effective gas-tight seal.

When the fully engaged position of the closure 12 on the vessel opening 10 is reached, the locking ribs click over the top of the respective ramped surfaces 40 and into abutment with the steep retaining surfaces of the ratchet ramps. At the same position, the second ends 74 of the first thread segments 18 may come into abutment with the stop shoulders 72 at the top of the second thread segments, thereby blocking further tightening of the closure than could damage the threads and/or over-compress the sealing liner.

When the closure 12 is in the fully engaged position on the vessel opening 10, the upper surfaces of the first thread segments 16 abut against the upper regions 28 of the upper thread surfaces 24 of the projecting portions of the second thread segment 20, as shown in FIG. 3. The upper surface of the first thread segments has a low pitch to match that of the upper regions 28, so as to maximise the contact area between the projecting portions in the regions 28, and thereby distribute the axial force exerted by the closure as evenly as possible around the vessel opening. Because of the low pitch in the regions 28, relatively little of the axial force emerging from the vessel due to pressure inside the vessel is converted into unscrewing rotational force by the abutment between the thread surfaces in this position. This greatly reduces the tendency of the closure to unscrew spontaneously under pressure. Spontaneous unscrewing is also prevented by the abutment between the locking ribs and the retaining edge on the locking ramps. An important advantage of the assembly is that the reduced tendency to unscrew spontaneously due to the low pitch of the thread in the lower regions 28 means that the minimum opening torque of the locking elements 38 can be reduced without risk of the closure blowing off spontaneously. This makes the closure easier to remove by elderly or arthritic people, or by children, without reducing the pressure safety of the closure.

In use, the closure is removed from the vessel by simple unscrewing. An initial, minimum unscrewing torque is required to overcome the resistance of the locking elements 38. Once this resistance has been overcome, essentially no torque needs to be applied by the user to unscrew the closure. The internal pressure inside the vessel exerts an axial force on the closure in a direction emerging from the vessel opening, as a result of which the first thread segments 18 ride along the upper surfaces 28 of the projecting portions of the second thread segments 20 as the closure is unscrewed. The first thread segments initially ride along the upper regions 28, and then along the steeply pitched intermediate regions 30 of the upper surface of the second thread segments 20. The first thread segments 18 then come into abutment with lower projecting portion 32 of the second thread segments 20. In this position, further unscrewing of the closure is blocked while gas venting takes place along the thread paths 26. It should also be noted that, in this intermediate gas venting position, the first thread segments 18 abut primarily against the region 34 of the upper surface of the second thread segments 20. The low pitch of this region 34 results in relatively little of the axial force on the closure being converted into unscrewing rotational torque, thereby reducing the tendency of the closure to override the pressure safety feature and blow off.

Once gas venting from inside the vessel is complete so that there is no longer axial upward force on the closure, the closure can drop down so as to bring the thread segments 18 into abutment with the lower surfaces 22 of the second thread segments 20. In this position, unscrewing can be continued to disengage the closure completely from the vessel.

The above embodiment has been described by way of example only. Many other embodiments of the present invention falling within the scope of the accompanying claims will be apparent to the skilled reader. In particular, the present invention is not limited to closure assemblies for drinking vessels, or to containers formed from molded thermoplastics.

The invention claimed is:

1. A threaded closure assembly for a wide mouth vessel, said assembly comprising:

a vessel opening;

a closure for said opening, the closure having a base portion and a skirt portion;

a first screw thread on the opening, said first screw thread comprising one or more first thread segments;

a second screw thread on an inner surface of the skirt of the closure, said second screw thread comprising one or more second thread segments;

said first and second screw threads being configured to enable a user to secure, remove and resecure the closure into a sealing position on the opening by rotation of the closure on the opening by a continuous smooth rotation through about 90° or less;

wherein said first thread segments are shorter than said second thread segments; and wherein the second thread segments are each made up of one or more circumferentially spaced projecting portions, each said portion extending circumferentially no more than about 60° around the closure skirt the second thread segments forming a substantially continuous helical thread path.

2. A closure assembly according to claim 1, wherein the vessel has a base and substantially tubular side walls, and the cross-sectional area of the opening is at least 50% of the cross-sectional area of the base.

3. A closure assembly according to claim 1, wherein there are four or more of said first thread segments.

4. A closure assembly according to claim 1, wherein at least one of the first thread segments extends circumferentially from 5 mm to 30 mm around the container neck.

5. A closure assembly according to claim 4, wherein at least one of the first thread segments extends circumferentially from 10 mm to 20 mm around the container neck.

6. A closure assembly according to claim 1, wherein at least one of the first thread segments has an upper or a lower surface with a mean pitch of from 5° to 25°.

7. A closure assembly according to claim 1, wherein at least one of the first thread segments has an upper or a lower surface with a constant pitch region extending for at least 10 mm around the vessel opening.

8. A closure assembly according to claim 1, wherein at least one of the second thread segments extends for at least 45° around the closure skirt.

9. A closure assembly according to claim 1, wherein at least one of the second thread segments is made up of two or more projecting portions.

10. A closure assembly according to claim 1, wherein the radially spaced projecting portions each extend less than about 45° around the closure skirt.

11. A closure assembly according to claim 1, wherein the radially spaced projecting portions are radially spaced apart by gaps extending radially from 0 to about 10°.

12. A closure assembly according to claim 1, wherein the maximum radial height of the first and/or the second thread segments is from about 0.5 to about 3 mm.

13. A closure assembly according to claim 1, further comprising mutually engageable elements on the vessel opening and the closure to block or restrict rotation of the closure in an unscrewing direction beyond an intermediate position when the closure is under axial pressure in a direction emerging from the vessel.

14. A closure assembly according to claim 1, wherein the second thread segments define a substantially continuous helical thread path along which said first thread segments travel from a substantially fully disengaged to a substantially fully secured position of the closure on the vessel.

15. A closure assembly according to claim 14, wherein the mean pitch of said helical thread path is from 5 to 20 degrees.

16. A closure assembly according to claim 1, wherein the second thread segments define at least one recess for receiving said first thread segments, said recess being substantially helical and extending for more than 30 degrees around the closure skirt.

17. A closure assembly according to claim 1, wherein there are four or more of the second thread segments.

18. A closure assembly according to claim 1, wherein at least one of the second thread segments has a smoothed cross section.

19. A closure assembly according to claim 1, wherein the first thread segments have a cross-section along the longitudinal axis of the assembly that is rounded, chamfered, trapezoidal or triangular.

20. A closure assembly according to claim 1, wherein the closure can be moved from a fully released to a fully engaged position on the vessel by a single smooth rotation through about 90 degrees or less.

21. A closure assembly according to claim 20, wherein the closure can be moved from a fully released to a fully engaged position on the vessel by a single smooth rotation through about 60 degrees or less.

22. A closure assembly according to claim 21, wherein the closure can be moved from a fully released to a fully engaged position on the vessel by a single smooth rotation through about 45 degrees or less.

23. A closure assembly according to claim 1, further comprising complementary locking means on the vessel opening and the closure that resist unscrewing of the closure form the fully engaged position on the vessel after the closure has been secured or resecured on the vessel until a predetermined minimum opening torque is applied.

24. A closure assembly according to claim 23, wherein the locking means on the vessel opening comprises a projection or recess for engagement with a complementary projection or recess on the closure skirt.

25. A closure assembly according to claim 1, wherein the vessel is formed from a material selected from the group consisting of thermoplastics, glass, metal, and combinations thereof.

26. A closure assembly according to claim 1 in which the first thread segments comprise helical thread segments having rounded ends.

* * * * *